US005691131A

United States Patent [19]

Maskasky

[11] Patent Number: 5,691,131

[45] Date of Patent: *Nov. 25, 1997

[54] HIGH BROMIDE TABULAR GRAIN EMULSIONS WITH DISLOCATIONS IN PERIPHERAL REGIONS

[75] Inventor: Joe E. Maskasky, Rochester, N.Y.

[73] Assignee: Eastman Kodak Company, Rochester, N.Y.

[ * ] Notice: The term of this patent shall not extend beyond the expiration date of Pat. No. 5,604,085.

[21] Appl. No.: 754,584

[22] Filed: Nov. 21, 1996

[51] Int. Cl.[6] ..... G03C 1/005; G03C 1/047

[52] U.S. Cl. ..... 430/639; 430/567; 430/569

[58] Field of Search ..... 430/567, 569, 430/639

[56] References Cited

U.S. PATENT DOCUMENTS

| | | | |
|---|---|---|---|
| 4,433,048 | 2/1984 | Solberg et al. | 430/434 |
| 4,439,520 | 3/1984 | Kofron et al. | 430/434 |
| 4,806,461 | 2/1989 | Ikeda et al. | 430/567 |
| 5,096,806 | 3/1992 | Nakamura et al. | 430/567 |
| 5,476,760 | 12/1995 | Fenton et al. | 430/567 |
| 5,604,085 | 2/1997 | Maskasky | 430/567 |

OTHER PUBLICATIONS

James, "The Theory of the Photographic Process" 4th Ed., Macmillan, 1977, p.51.

Mees, "The Theory of the Photographic Process", Rev. Ed., Macmillan, 1951, pp. 48–49.

"Research Disclosure", vol. 389, Sep. 1996, Item 38957, II. A.

*Primary Examiner*—Thorl Chea

*Attorney, Agent, or Firm*—Carl O. Thomas

[57] ABSTRACT

A photographic emulsion is disclosed comprised of a radiation-sensitive high bromide tabular grain emulsion. At least 50 percent of total grain projected area is accounted for by tabular grains each comprised of (a) less than 12 mole percent iodide and greater than 50 mole percent bromide, based on silver, (b) a central region accounting for at least 50 percent of grain projected area, and (c) a peripheral region containing crystal lattice dislocations and a higher iodide concentration than the overall average iodide concentration of the tabular grains. The emulsion contains a hydrophilic colloid peptizer derived from a water dispersible cationic starch.

The iodide and dislocations in the peripheral regions contribute to increased photographic speeds. The water dispersing cationic starch facilitates emulsion precipitation and chemical sensitization.

15 Claims, No Drawings

HIGH BROMIDE TABULAR GRAIN EMULSIONS WITH DISLOCATIONS IN PERIPHERAL REGIONS

FIELD OF THE INVENTION

The invention relates to silver halide emulsions useful in photography.

DEFINITION OF TERMS

In referring to grains and emulsions containing two or more halides, the halides are named in order of ascending concentrations.

The term "high bromide" in referring to grains and emulsions indicates that bromide is present in a concentration of greater than 50 mole percent, based on total silver.

The term "low surface iodide" in referring to grains indicates that iodide is present in a concentration of less than 2 mole percent, based on silver within 0.02 μm of the surface of the grains.

The term "equivalent circular diameter" or "ECD" is employed to indicate the diameter of a circle having the same projected area as a silver halide grain.

The term "coefficient of variation" or "COV" is defined as 100 times the standard deviation of grain ECD divided by average grain ECD.

The term "monodisperse" in referring to the grain population of a silver halide emulsion indicates a COV of less than 30 percent.

The term "aspect ratio" designates the ratio of grain ECD to grain thickness (t).

The term "tabular grain" indicates a grain having two parallel crystal faces which are clearly larger than any remaining crystal face and an aspect ratio of at least 2.

The term "tabular grain emulsion" refers to an emulsion in which tabular grains account for greater than 50 percent of total grain projected area.

The term "cationic" in referring to starch indicates that the starch molecule has a net positive charge at the pH of intended use.

The term "oxidized" in referring to starch indicates a starch in which, on average, at least one α-D-glucopyranose repeating unit per starch molecule has been ring opened by cleavage of the 2 and 3 ring position carbon-to-carbon bond.

The term "water dispersible" in referring to cationic starches indicates that, after boiling the cationic starch in water for 30 minutes, the water contains, dispersed to at least a colloidal level, at least 1.0 percent by weight of the total cationic starch.

*Research Disclosure* is published by Kenneth Mason Publications, Ltd., Dudley House, 12 North St., Emsworth, Hampshire P010 7DQ, England.

BACKGROUND

Radiation-sensitive silver halide emulsions employed in radiographic elements are comprised of a dispersing medium and silver halide microcrystals, commonly referred to as grains. As the grains are precipitated from an aqueous medium, a hydrophilic colloid peptizer is adsorbed to the grain surfaces to prevent the grains from agglomerating. Subsequently binder is added to the emulsion and, after coating, the emulsion is dried. The peptizer and binder are collectively referred to as the vehicle of an emulsion.

Gelatin and gelatin derivatives form both the peptizer and the major portion of the remainder of the vehicle in the overwhelming majority of silver halide radiographic elements. An appreciation of gelatin is provided by this description contained in Mees *The Theory of the Photographic Process*, Revised Ed., Macmillan, 1951, pp. 48 and 49:

> Gelatin is pre-eminently a substance with a history; its properties and its future behavior are intimately connected with its past. Gelatin is closely akin to glue. At the dawn of the Christian era, Pliny wrote, "Glue is cooked from the hides of bulls." It is described equally shortly by a present-day writer as "the dried down soup or consommé of certain animal refuse." The process of glue making is age-old and consists essentially in boiling down hide clippings or bones of cattle and pigs. The filtered soup is allowed to cool and set to a jelly which, when cut and dried on nets, yields sheets of glue or gelatin, according to the selection of stock and the process of manufacture. In the preparation of glue, extraction is continued until the ultimate yield is obtained from the material; in the case of gelatin, however, the extraction is halted earlier and is carried out at lower temperatures, so that certain strongly adhesive but nonjelling constituents of glue are not present in gelatin. Glue is thus distinguished by its adhesive properties; gelatin by its cohesive properties, which favor the formation of strong jellies.
>
> Photographic gelatin is generally made from selected clippings of calf hide and ears as well as cheek pieces and pates. Pigskin is used for the preparation of some gelatin, and larger quantities are made from bone. The actual substance in the skin furnishing the gelatin is collagen. It forms about 35 per cent of the coria of fresh cattle hide. The corresponding tissue obtained from bone is termed ossein. The raw materials are selected not only for good structural quality but for freedom from bacterial decomposition. In preparation for the extraction, the dirt with loose flesh and blood is eliminated in a preliminary wash. The hair, fat, and much of the albuminous materials are removed by soaking the stock in limewater containing suspended lime. The free lime continues to rejuvenate the solution and keeps the bath at suitable alkalinity. This operation is followed by deliming with dilute acid, washing, and cooking to extract the gelatin. Several "cooks" are made at increasing temperatures, and usually the products of the last extractions are not employed for photographic gelatin. The crude gelatin solution is filtered, concentrated if necessary, cooled until it sets, cut up, and dried in slices. The residue, after extraction of the gelatin, consists chiefly of elastin and reticulin with some keratin and albumin.
>
> Gelatin may also be made by an acid treatment of the stock without the use of lime. The stock is treated with dilute acid (pH 4.0) for one to two months and then washed thoroughly, and the gelatin is extracted. This gelatin differs in properties from gelatin made by treatment with lime.

In addition to the collagen and ossein sought to be extracted in the preparation of gelatin there are, of course, other materials entrained. For example, James *The Theory of the Photographic Process*, 4th Ed., Macmillan, 1977, p. 51, states:

> Although collagen generally is the preponderant protein constituent in its tissue of origin, it is always associated with various "ground substances" such as noncollagen protein, mucopolysaccharides, polynucleic acid, and lipids. Their more or less complete removal is desirable in the preparation of photographic gelatin.

Superimposed on the complexity of composition is the variability of composition, attributable to the varied diets of the animals providing the starting materials. The most notorious example of this was provided by the forced suspension of manufacturing by the Eastman Dry Plate Company in 1882, ultimately attributed to a reduction in the sulfur content in a purchased batch of gelatin.

Considering the time, effort, complexity and expense involved in gelatin preparation, it is not surprising that research efforts have in the past been mounted to replace the gelatin used in photographic emulsions and other film layers. However, by 1970 any real expectation of finding a generally acceptable replacement for gelatin had been abandoned. A number of alternative materials have been identified as having peptizer utility, but none have found more than limited acceptance. Of these, cellulose derivatives are by far the most commonly named, although their use has been restricted by the insolubility of cellulosic materials and the extensive modifications required to provide peptizing utility.

*Research Disclosure,* Vol. 389, Sept. 1996, Item 38957, II. Vehicles, vehicle extenders, vehicle-like addenda and vehicle related addenda, A. Gelatin and hydrophilic colloid peptizers, paragraph (1) states:

(1) Photographic silver halide emulsion layers and other layers on photographic elements can contain various colloids alone or in combination as vehicles. Suitable hydrophilic materials include both naturally occurring substances such as proteins, protein derivatives, cellulose derivatives—e.g., cellulose esters, gelatin—e.g., alkali-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like . . .

In the early 1980's a marked advance occurred in silver halide emulsions used in photography and radiography. Specifically, numerous performance advantages were realized to flow from the use of tabular grain emulsions. Tabular grain emulsions offer advantages in convering power, image sharpness, developability, speed-granularity relationships, and increased separation of blue and minus blue (green and/or red) speeds in minus blue spectrally sensitized emulsions. Kofron et al U.S. Pat. No. 4,439,520 demonstrates both a variety of tabular grain emulsion compositions and performance advantages.

Sometime after iodide containing high bromide tabular grain emulsions appeared in commercial photographic films Ikeda et al U.S. Pat. No. 4,806,461 microscopically examined silver iodobromide tabular grains and concluded that their superior speed-granularity performance could in part be attributed to the presence of crystal lattice dislocations. When examined by transmission electron microscopy, dislocations appear as lines and, in high densities, as intersecting networks of lines. The Ikeda et al correlation of dislocations with improved speed-granularity has stimulated intensive further investigation of crystal lattice dislocations.

From these investigations it has been gradually realized that the disproportionate location of crystal lattice dislocations within peripheral regions of the tabular grains rather than randomly provides a further incremental improvement in speed-granularity relationships. Siting of crystal lattice dislocations in peripheral regions of the grains is typically achieved by increasing the concentration of iodide and controlling its method of addition after at least half the total silver forming the tabular grains has been precipitated. Techniques for introducing iodide during precipitation of peripheral tabular grain regions include abrupt iodide ion addition, as taught by Solberg et al U.S. Pat. No. 4,433,048, and, more recently, partial halide conversion by the controlled addition of potassium iodide, followed by further silver halide precipitation along the edges of the tabular grains, as illustrated by Fenton et al U.S. Pat. No. 5,476,760 and Nakamura et al U.S. Pat. No. 5,096,806.

RELATED PATENT APPLICATIONS

Maskasky U.S. Ser. No. 08/643,225, filed May 2, 1996, now allowed, claiming priority from U.S. Ser. No. 08/574,664, filed Dec. 19, 1995, now abandoned and Ser. No. 60/001579, filed Jul. 27, 1995, commonly assigned, titled HIGH BROMIDE TABULAR GRAIN EMULSIONS IMPROVED BY PEPTIZER SELECTION, is directed to high bromide {111} tabular grain emulsions in which the peptizer is a water dispersible cationic starch.

Maskasky U.S. Ser. No. 08/574,833, filed Dec. 19, 1995, now U.S. Pat. No. 5,604,085, claiming priority from U.S. Ser. No. 60/001580, filed Jul. 27, 1995, titled HIGH BROMIDE ULTRATHIN TABULAR GRAIN EMULSIONS IMPROVED BY PEPTIZER SELECTION, commonly assigned, is directed to high bromide ultrathin (111) tabular grain emulsions in which the peptizer is a water dispersible cationic starch.

Maskasky U.S. Ser. No. 08/662,300, filed Jul. 28, 1996, claiming priority from U.S. Ser. No. 08/574,834, filed Dec. 19, 1995, and Ser. No. 60/002,089, filed Aug. 16, 1995, commonly assigned, titled PHOTOGRAPHIC EMULSIONS IMPROVED BY PEPTIZER MODIFICATION, is directed to radiation-sensitive silver halide emulsions containing oxidized cationic starch as a peptizer.

Maskasky U.S. Ser. No. 08/574,489, filed Dec. 19, 1995, claiming priority from U.S. Ser. No. 60/002101, filed Aug. 10, 1995, commonly assigned, titled HIGH BROMIDE ULTRATHIN TABULAR GRAIN EMULSIONS IMPROVED BY PEPTIZER MODIFICATION, is directed to radiation-sensitive high bromide ultrathin tabular grain emulsions containing oxidized cationic starch as a peptizer.

SUMMARY OF THE INVENTION

This invention has as its purpose to provide iodide containing high bromide tabular grain emulsions with iodide managed to realize a favorable speed-granularity relationship which contains a simpler, more easily prepared hydrophilic colloid peptizer than conventional gelatino-peptizer.

In one aspect this invention is directed to a photographic emulsion comprised of radiation-sensitive silver halide grains and a hydrophilic colloid peptizer, wherein (1) at least 50 percent of total grain projected area is accounted for by tabular grains each comprised of (a) less than 12 mole percent iodide and greater than 50 mole percent bromide, based on silver, (b) a central region accounting for at least 50 percent of grain projected area, and (c) a peripheral region containing crystal lattice dislocations and a higher iodide concentration than the overall average iodide concentration of the tabular grains, and (2) the hydrophilic colloid peptizer is derived from a water dispersible cationic starch.

It has been discovered quite surprisingly that cationic starches are better suited for preparing iodide containing high bromide {111} tabular grain emulsions than non-cationic starches and that cationic starches, when present in place of gelatin facilitate imaging advantages. Cationic starches exhibit lower levels of viscosity than have previously been present in preparing tabular grain emulsions, and viscosity is reduced even further when the cationic starch is oxidized. The lower viscosity provided by cationic starch allows better uniformity of tabular grain characteristics, including iodide placement and the placement of crystal lattice dislocations produced by iodide. Oxidized cationic starch allows emulsion precipitation at ambient temperatures. Additionally, oxidized cationic starch allows chemical sensitization at even lower temperatures than cationic starch.

DESCRIPTION OF PREFERRED EMBODIMENTS

The present invention is directed to photographic emulsions containing radiation-sensitive high bromide tabular silver halide grains exhibiting an iodide concentration and placement chosen to improve speed-granularity characteristics and prepared in the presence of a peptizer derived from a water dispersible cationic starch.

A distinguishing feature of the photographic emulsions of the invention is that the peptizer is derived from a water dispersible cationic starch.

The term "starch" is employed to include both natural starch and modified derivatives, such as dextrinated, hydrolyzed, oxidized, alkylated, hydroxyalkylated, acetylated or fractionated starch. The starch can be of any origin, such as corn starch, wheat starch, potato starch, tapioca starch, sago starch, rice starch, waxy corn starch or high amylose corn starch.

Starches are generally comprised of two structurally distinctive polysaccharides, α-amylose and amylopectin. Both are comprised of α-D-glucopyranose units. In α-amylose the α-D-glucopyranose units form a 1,4-straight chain polymer. The repeating units take the following form:

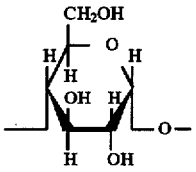

(I)

In amylopectin, in addition to the 1,4-bonding of repeating units, 6-position chain branching (at the site of the —$CH_2OH$ group above) is also in evidence, resulting in a branched chain polymer. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, but not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

The water dispersible starches employed in the practice of the invention are cationic—that is, they contain an overall net positive charge when dispersed in water. Starches are conventionally rendered cationic by attaching a cationic substituent to the α-D-glucopyranose units, usually by esterification or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

To be useful as a peptizer the cationic starch must be water dispersible. Many starches disperse in water upon heating to temperatures up to boiling for a short time (e.g., 5 to 30 minutes). High sheer mixing also facilitates starch dispersion. The presence of cationic substituents increases the polar character of the starch molecule and facilitates dispersion. The starch molecules preferably achieve at least a colloidal level of dispersion and ideally are dispersed at a molecular level—i.e., dissolved.

The following teachings, the disclosures of which are here incorporated by reference, illustrate water dispersible cationic starches within the contemplation of the invention:

*Rutenberg et al U.S. Pat. No. 2,989,520;
Meisel U.S. Pat. No. 3,017,294;
Elizer et al U.S. Pat. No. 3,051,700;
Aszolos U.S. Pat. No. 3,077,469;
Elizer et al U.S. Pat. No. 3,136,646;
*Barber et at U.S. Pat. No. 3,219,518;
*Mazzarella et al U.S. Pat. No. 3,320,080;
Black et al U.S. Pat. No. 3,320,118;
Caesar U.S. Pat. No. 3,243,426;
Kirby U.S. Pat. No. 3,336,292;
Jarowenko U.S. Pat. No. 3,354,034;
Caesar U.S. Pat. No. 3,422,087;
*Dishburger et al U.S. Pat. No. 3,467,608;
*Beaninga et al U.S. Pat. No. 3,467,647;
Brown et al U.S. Pat. No. 3,671,310;
Cescato U.S. Pat. No. 3,706,584;
Jarowenko et al U.S. Pat. No. 3,737,370;
*Jarowenko U.S. Pat. No. 3,770,472;
Moser et al U.S. Pat. No. 3,842,005;
Tessler U.S. Pat. No. 4,060,683;
Rankin et al U.S. Pat. No. 4,127,563;
Huchette et al U.S. Pat. No. 4,613,407;
Blixt et al U.S. Pat. No. 4,964,915;
*Tsai et al U.S. Pat. No. 5,227,481; and
*Tsai et al U.S. Pat. No. 5,349,089.

In a specifically preferred form the starch is oxidized either before (* patents above) or following the addition of cationic substituents. This is accomplished by treating the starch with a strong oxidizing agent. Both hypochlorite ($ClO^-$) or periodate ($IO_4^-$) have been extensively used and investigated in the preparation of commercial starch derivatives and are preferred. While any convenient counter ion can be employed, preferred counter ions are those fully compatible with silver halide emulsion preparation, such as alkali and alkaline earth cations, most commonly sodium, potassium or calcium.

When the oxidizing agent opens the α-D-glucopyranose ring, the oxidation sites are at the 2 and 3 position carbon atoms forming the α-D-glucopyranose ring. The 2 and 3 position

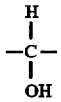

groups are commonly referred to as the glycol groups. The carbon-to-carbon bond between the glycol groups is replaced in the following manner:

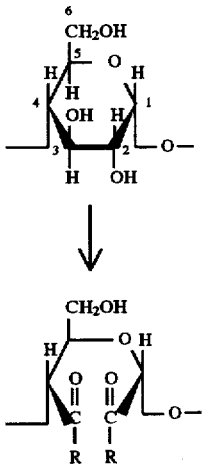

(II)

where R represents the atoms completing an aldehyde group or a carboxyl group.

The hypochlorite oxidation of starch is most extensively employed in commercial use. The hypochlorite is used in small quantities (<0.1% by weight chlorine, based on total starch) to modify impurities in starch, most notably to bleach colored impurities. Any modification of the starch at these low levels is minimal, at most affecting only the polymer chain terminating aldehyde groups, rather than the α-D-glucopyranose repeating units themselves. At levels of oxidation that affect the α-D-glucopyranose repeating units the hypochlorite affects the 2, 3 and 6 positions, forming aldehyde groups at lower levels of oxidation and carboxyl groups at higher levels of oxidation. Oxidation is conducted at mildly acidic or alkaline pH (e.g., >5 to 11). The oxidation reaction is exothermic, requiring cooling of the reaction mixture. Temperatures of less than 45° C. are preferably maintained. Using a hypobromite oxidizing agent is known to produce similar results as hypochlorite.

Hypochlorite oxidation is catalyzed by the presence of bromide ions. Since silver halide emulsions are conventionally precipitated in the presence of a stoichiometric excess of the halide to avoid inadvertent silver ion reduction (fogging), it is conventional practice to have bromide ions in the dispersing media of high bromide silver halide emulsions. Thus, it is specifically contemplated to add bromide ion to the starch prior to performing the oxidation step in the concentrations known to be useful in the precipitation of silver halide emulsions.

Cescato U.S. Pat. No. 3,706,584, the disclosure of which is here incorporated by reference, discloses techniques for the hypochlorite oxidation of cationic starch. Sodium bromite, sodium chlorite and calcium hypochlorite are named as alternatives to sodium hypochlorite. Further teachings of the hypochlorite oxidation of starches is provided by the following: R. L. Whistler, E. G. Linke and S. Kazeniac, "Action of Alkaline Hypochlorite on Corn Starch Amylose and Methyl 4-O-Methyl-D-glucopyranosides", *Journal Amer. Chem. Soc.*, Vol. 78, pp. 4704–9 (1956); R. L. Whistler and R. Schweiger, "Oxidation of Amylopectin with Hypochlorite at Different Hydrogen Ion Concentrations, *Journal Amer. Chem. Soc., Vol.* 79, pp. 6460–6464 (1957); J. Schmorak, D. Mejzler and M. Lewin, "A Kinetic Study of the Mild Oxidation of Wheat Starch by Sodium Hypochloride in the Alkaline pH Range", *Journal of Polymer Science,* Vol. XLIX, pp. 203–216 (1961); J. Schraorak and M. Lewin, "The Chemical and Physico-chemical Properties of Wheat Starch with Alkaline Sodium Hypochlorite", *Journal of Polymer Science:* Part A, Vol. 1, pp. 2601–2620 (1963); K. F. Patel, H. U. Mehta and H. C. Srivastava, "Kinetics and Mechanism of Oxidation of Starch with Sodium Hypochlorite", *Journal of Applied Polymer Science,* Vol. 18, pp. 389–399 (1974); R. L. Whistler, J. N. Bemiller and E. F. Paschall, *Starch: Chemistry and Technology*, Chapter X, Starch Derivatives: Production and Uses, II. Hypochlorite-Oxidized Starches, pp. 315–323, Academic Press, 1984; and O. B. Wurzburg, *Modified Starches: Properties and Uses,* III. Oxidized or Hypochlorite-Modified Starches, pp. 23–28 and pp. 245–246, CRC Press (1986). Although hypochlorite oxidation is normally carried out using a soluble salt, the free acid can alternatively be employed, as illustrated by M. E. McKillican and C. B. Purves, "Estimation of Carboxyl, Aldehyde and Ketone Groups in Hypochlorous Acid Oxystarches", Can. *J. Chem., Vol.* 312–321 (1954).

Periodate oxidizing agents are of particular interest, since they are known to be highly selective. The periodate oxidizing agents produce starch dialdehydes by the reaction shown in the formula (II) above without significant oxidation at the site of the 6 position carbon atom. Unlike hypochlorite oxidation, periodate oxidation does not produce carboxyl groups and does not produce oxidation at the 6 position. Mehltretter U.S. Pat. No. 3,251,826, the disclosure of which is here incorporated by reference, discloses the use of periodic acid to produce a starch dialdehyde which is subsequently modified to a cationic form. Mehltretter also discloses for use as oxidizing agents the soluble salts of periodic acid and chlorine. Further teachings of the periodate oxidation of starches is provided by the following: V. C. Barry and P. W. D. Mitchell, "Properties of Periodate-oxidised Polysaccharides. Part II. The Structure of some Nitrogen-containing Polymers", *Journal Amer. Chem. Soc.,* 1953, pp. 3631–3635; P. J. Borchert and J. Mirza, "Cationic Dispersions of Dialdehyde Starch I. Theory and Preparation", *Tappi,* Vol. 47, No. 9, pp. 525–528 (1964); J. E. McCormick, "Properties of Periodate-oxidised Polysaccharides. Part VII. The Structure of Nitrogen-containing Derivatives as deduced from a Study of Monosaccharide Analogues", *Journal Amer. Chem. Soc.*, pp. 2121–2127 (1966); and O. B. Wurzburg, *Modified Starches: Properties and Uses,* III. Oxidized or Hypochlorite-Modified Starches, pp. 28–29, CRC Press (1986).

Starch oxidation by electrolysis is disclosed by F. F. Farley and R. M. Hixon, "Oxidation of Raw Starch Granules by Electrolysis in Alkaline Sodium Chloride Solution", *Ind. Eng. Chem.,* Vol. 34, pp. 677–681 (1942).

Depending upon the choice of oxidizing agents employed, one or more soluble salts may be released during the oxidation step. Where the soluble salts correspond to or are similar to those conventionally present during silver halide precipitation, the soluble salts need not be separated from the oxidized starch prior to silver halide precipitation. It is, of course, possible to separate soluble salts from the oxidized cationic starch prior to precipitation using any conventional separation technique. For example, removal of halide ion in excess of that desired to be present during grain precipitation can be undertaken. Simply decanting solute and dissolved salts from oxidized cationic starch particles is a simple alternative. Washing under conditions that do not solubilize the oxidized cationic starch is another preferred option. Even if the oxidized cationic starch is dispersed in a solute during oxidation, it can be separated using conventional ultrafiltration techniques, since there is a large molecular size separation between the oxidized cationic starch and soluble salt by-products of oxidation.

The carboxyl groups formedby oxidation take the form —C(O)OH, but, if desired, the carboxyl groups can, by further treatment, take the form —C(O)OR', where R' represents the atoms forming a salt or ester. Any organic moiety added by esterification preferably contains from 1 to 6 carbon atoms and optimally from 1 to 3 carbon atoms.

The minimum degree of oxidation contemplated is that required to reduce the viscosity of the starch. It is generally accepted (see citations above) that opening an α-D-glucopyranose ring in a starch molecule disrupts the helical configuration of the linear chain of repeating units which in turn reduces viscosity in solution. It is contemplated that at least one α-D-glucopyranose repeating unit per starch polymer, on average, be ring opened in the oxidation process. As few as two or three opened α-D-glucopyranose rings per polymer has a profound effect on the ability of the starch polymer to maintain a linear helical configuration. It is generally preferred that at least 1 percent of the glucopyranose rings be opened by oxidation.

A preferred objective is to reduce the viscosity of the cationic starch by oxidation to less than four times (400 percent of) the viscosity of water at the starch concentrations employed in silver halide precipitation. Although this viscosity reduction objective can be achieved with much lower levels of oxidation, starch oxidations of up to 90 percent of the α-D-glucopyranose repeating units have been reported (Wurzburg, cited above, p. 29). However, it is generally preferred to avoid driving oxidation beyond levels required for viscosity reduction, since excessive oxidation results in increased chain cleavage. A typical convenient range of oxidation ring-opens from 3 to 50 percent of the α-D-glucopyranose rings.

The water dispersible cationic starch is present during the precipitation (during nucleation and grain growth or during grain growth) of the high bromide (111) tabular grains. Preferably precipitation is conducted by substituting the water dispersible cationic starch for all conventional gelatino-peptizers. In substituting the selected cationic starch peptizer for conventional gelatino-peptizers, the concentrations of the selected peptizer and the point or points of addition can correspond to those employed using gelatino-peptizers.

In addition, it has been unexpectedly discovered that emulsion precipitation can tolerate even higher concentrations of the selected peptizer. For example, it has been observed that all of the selected peptizer required for the preparation of an emulsion through the step of chemical sensitization can be present in the reaction vessel prior to grain nucleation. This has the advantage that no peptizer additions need be interjected after tabular grain precipitation has commenced. It is generally preferred that from 1 to 500 grams (most preferably from 5 to 100 grams) of the selected peptizer per mole of silver to be precipitated be present in the reaction vessel prior to tabular grain nucleation.

At the other extreme, it is, of course, well known, as illustrated by Mignot U.S. Pat. No. 4,334,012, here incorporated by reference, that no peptizer is required to be present during grain nucleation, and, if desired, addition of the selected peptizer can be deferred until grain growth has progressed to the point that peptizer is actually required to avoid tabular grain agglomeration.

At least 50 percent of total projected area of the silver halide grains contemplated to be prepared in the peptizer derived from a water dispersible cationic starch, hereinafter also referred to as the "selected peptizer", are tabular grains each comprised of (a) less than 12 mole percent iodide and greater than 50 mole percent bromide, based on silver, (b) a central region accounting for at least 50 percent of the projected area of the tabular grain, and (c) a peripheral region containing dislocations and a higher iodide concentration than the overall iodide concentration of the tabular grains.

The tabular grains satisfying criteria (a), (b) and (c) are preferably prepared by substituting the selected peptizer for a conventional gelatino-peptizer in one of the following emulsion tabular grain precipitation methods:

A. The dump iodide addition method or

B. The partial halide conversion method.

In method A a high bromide host tabular grain emulsion is precipitated that contains at least 50 (preferably at least 75) percent of the total silver forming the final emulsion. The tabular grains provided in the host emulsion form the central portion of the tabular grains as fully precipitated. Iodide in the host tabular grains is preferably limited to less than about 6 (optimally less than 3) mole percent, based on silver. Silver bromide host tabular grains are contemplated. When the iodide concentration in the host tabular grains is at least 0.5 mole percent, based on silver, it is preferred to reduce the iodide concentration of the last precipitated portion of the host tabular grains to less than half that of the previously precipitated portion. Preferably iodide withheld while precipitating the last precipitated portion of the host tabular grains. The last precipitated portion accounts for at least 2 percent of the total silver forming the host tabular grains.

To add the peripheral region silver and iodide ions (either as fine grains are salt solutions) are abruptly added to the host tabular grain emulsion. Coprecipitated bromide ions can be provided by the stoichiometric excess of bromide ion in the dispersing medium of the host tabular grain emulsion or can be supplied from an external source in addition to the silver and iodide ion sources.

The peripheral region contains a higher iodide concentration than the overall average iodide concentration of the emulsion. Preferably the iodide ion concentration of the peripheral region is at least twice the iodide concentration of the central region. The iodide concentration of the peripheral region can range from 0.5 (preferably at least 1.0) mole percent, based on silver in the peripheral region, up to (and locally exceeding) the saturation level of iodide ion the silver bromide face centered cubic rock salt crystal lattice structure.

The benefits of iodide addition in the peripheral region are not determined solely by the iodide concentration level, but also by the method of addition. Abrupt incorporation of iodide ion into the face centered cubic rock salt crystal lattice formed by silver bromide produces dislocations in the crystal lattice structure that are responsible for increasing speed beyond that which can be realized by a slower incorporation of iodide ion. The more rapid the addition of iodide ion, the higher its effectiveness in introducing crystal lattice dislocations. In its most abrupt form iodide ion addition is sometimes referred to an iodide "dump". The term "dump" is used to indicate the rate of iodide addition is not intentionally limited. That is, it occurs as close to instantaneously as possible using conventional precipitation equipment.

One technique for determining whether during formation of the peripheral region iodide ion has been added in a manner capable increasing speed is to view tabular grain samples by transmission electron microscopy (TEM). These observations reveal a higher incidence of crystal lattice dislocations in the peripheral region, usually with a higher concentration near the corners of the grains than elsewhere along their edges. At least 3 dislocations are contemplated to be observable in each peripheral region of the high bromide tabular grains, which grains account for at least 50 percent of total grain projected area.

An alternative technique for determining the presence of speed increasing crystal lattice disruptions attributable to abrupt iodide ion addition is to observe the spectral bands of stimulated fluorescent emission. For example, according to one technique the requisite crystal lattice dislocations for speed enhancement have been found to be present when, upon exposing the emulsion to 325 nm electromagnetic radiation at 6° K., a stimulated fluorescent emission at 575 nm is observed that is at least 5 percent of the maximum intensity of concurrently stimulated fluorescent emission in the wavelength region of from 490 to 560 nm.

After abrupt iodide precipitation it is usually preferred to precipitate at least 0.5 (preferably at least 1.0) percent of silver without further iodide ion addition. The final silver can be added under conditions that either directs the finally deposited silver halide to the edges of the tabular grains or forms a shell over the previously precipitated silver halide grains.

Since formation of the peripheral region introduces crystal lattice dislocations, it is usually preferred to grow the host tabular grains as close to the final mean ECD of the product emulsion as is conveniently possible prior to forming the peripheral region. Thus, the central region can account for up to about 97 percent of total silver forming the completed emulsion.

In the host tabular grain and final emulsions the tabular grains preferably account for 70 percent of total grain projected area. In most preferred that the tabular grains account for greater than 90 percent of total grain projected area. In specifically preferred preparation techniques the tabular grains can account for substantially all (>97%) of total grain projected area.

The tabular grains accounting for the various percentages of total grain projected area stated above preferably exhibit a thickness of less than 0.3 μm, most preferably less than 0.2 μm.

The tabular grain emulsions of the invention prepared by Method A can contain as little as 0.5 (preferably 1.0) mole percent iodide, based on total silver. For best overall photographic performance the overall average iodide concentration is preferably limited to less than 12 (most preferably <6) mole percent, based on total silver. Chloride, if present, is preferably limited to less than 10 mole percent, based on total silver. In one preferred form the emulsions produced by Method A are silver iodobromide emulsions.

Conventional techniques for preparing emulsions by Method A that can be adapted to the practice of the invention by substituting a selected peptizer for a conventional gelatino-peptizer are illustrated by the following, here incorporated by reference:

Solberg et al U.S. Pat. No. 4,433,048;
Antoniades et al U.S. Pat. No. 5,250,403;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Chang et al U.S. Pat. No. 5,314,793;
Chang et al U.S. Pat. No. 5,360,703.

The following patent, the disclosures of which are here incorporated by reference, disclose high bromide tabular grain emulsions that can be prepared in the presence of the selected peptizer for use as host tabular grain emulsions in the practice of the invention:

Daubendiek et al U.S. Pat. No. 4,414,310;
Abbott et al U.S. Pat. No. 4,425,426;
Wilgus et al U.S. Pat. No. 4,434,226;
Kofron et al U.S. Pat. No. 4,439,520;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840; and
Delton U.S. Pat. No. 5,372,927.

In Method B a low surface iodide high bromide host tabular grain emulsion is provided that is modified to create crystal lattice dislocations in a peripheral region by (1) introducing iodide ion in an aqueous solution into the host tabular grain emulsion while withholding addition of silver ion and (2) thereafter continuing growth of the host tabular grains modified by iodide ion introduction until silver added in this step accounts for from 10 to 40 percent of total silver.

In Method B the host tabular grain emulsion can be identical to that described above for Method A, except as specifically noted. In Method B the host tabular grains exhibit low surface iodide. That is, the iodide content within 0.02 μm of the grain surface is less than 2 mole percent iodide, based on silver. This protects the grains from loss of their tabular structure during partial halide conversion. In the patents cited above to show conventional high bromide tabular grain emulsions, any of the high bromide tabular grain emulsions exhibiting iodide concentrations at or near the grain surfaces of 2 mole percent or more can be converted to low surface iodide tabular grain emulsions merely by shelling the tabular grains with a high bromide silver halide containing less than 2 mole percent iodide, based on silver forming the shell.

It is recognized that it is generally most convenient to employ host tabular grain emulsions that exhibit low (<2 mole percent) iodide concentrations throughout the grains. The speed benefits of iodide incorporation are generally recognized in the art to be detectable at iodide concentrations as low as 0.5 mole percent with the speed benefits of iodide incorporation being largely realized at iodide concentrations of 1.0 mole percent. In specifically preferred forms the host tabular grain emulsions are silver iodobromide emulsions with low (<2 mole percent) iodide concentrations throughout the grains or silver bromide emulsions.

In Method B iodide ions are introduced into the host tabular grain emulsion while withholding the addition of silver ions. This results in iodide ions displacing halide ions already present in the crystal lattice of the host tabular grains. Hence the central region of the fully formed grains contains a somewhat lower percentage of the total silver than the host tabular grains. For this reason it is preferred that the host tabular grains present before partial halide conversions account for at least 60 percent of total silver. Except for this increased minimum percentage of total silver the host tabular grains employed in Method B can account for the same proportions of total silver in the final emulsions as described above.

The iodide ion introduced during the partial halide conversion step can account for up to 12 mole percent, based on total silver in the completed emulsion, where no iodide is added before or after the partial halide conversion step. Where iodide is initially present in the host tabular grains or added during step (2), the iodide ion added during the partial halide conversion step is limited to maintain the iodide concentration in the grains to less than 12 mole percent, based on total silver in the completed emulsion. However, at least 1 mole percent iodide, based on total silver, is introduced during the partial halide conversion step (1).

Following the partial halide conversion step additional silver halide is precipitated, accounting for from 10 to 40 percent of the total silver forming the grains of the completed emulsion. The halide composition of the silver halide precipitation following halide conversion can take any conventional form so long as the completed grains retain a high bromide content and a higher iodide content in the peripheral region than the central region of the tabular grains (see the description Method A above). The silver halide precipitated following halide conversion is preferably selected from among the silver halide compositions used to form the host tabular grains. In one form it is specifically preferred to introduce only silver and bromide salts in forming the final 10 to 40 percent of the grains. Alternatively, it is contemplated to introduce additional iodide, but preferably the iodide is limited to less than 2 mole percent, based on the silver being concurrently precipitated.

Any convenient conventional technique for precipitating the last 10 to 40 percent of the total silver to complete formation of the high bromide tabular grains can be employed. For example, any conventional grain shelling technique can be employed. Typically grain shelling is accomplished by concurrently introducing silver and halide salts through separate jets. Alternatively, a silver halide Lippmann emulsion can be introduced to achieve shelling of the grains.

Instead of shelling the tabular grains with the final 10 to 40 percent of precipitated silver it is contemplated to conduct precipitation under conditions conducive to continued tabular grain growth—that is, under conditions that favor silver halide deposition along the peripheral edges of the tabular grains. Such techniques are illustrated by the patents cited above to show host tabular grain preparations.

In another specific preferred technique for precipitating the final 10 to 40 percent of silver forming the tabular grains, further precipitation can be achieved by introducing a soluble silver salt, such as silver nitrate, without adding halide. Since high bromide silver halide emulsions are conventionally precipitated and maintained in a stoichiometric excess of bromide ion to avoid fogging the grains, the addition of silver ions without concurrent halide addition results in a reaction between the silver ions and the stoichiometric excess bromide ions. These bromide ions can in part be those supplied by the bromide ion introduction during the partial halide conversion step.

Partial halide conversion by iodide ion addition while withholding silver ion addition, like abrupt iodide ion addition with silver ion addition, creates crystal lattice defects in the peripheral region of the tabular grains. Microscopic examination has revealed that halide conversion is sometimes in evidence at some corners, but not others in the grains. For example, tabular grains with halide conversion induced crystal lattice dislocations confined to a single corner region have been observed.

Although some iodide redistribution over the entire surface of the tabular grains can occur in step (2), the large majority of iodide introduced during halide conversion remains in the peripheral regions of the tabular grains. However, the manner in which the iodide is distributed within the peripheral region can vary, depending upon the exact conditions under which step (2) is practiced. The dissimilar patterns of peripheral region iodide ion distribution reported by Nakamura et al U.S. Pat. No. 5,096,806 and Fenton et al U.S. Pat. No. 5,467,760, the disclosures of which are here incorporated by reference, can be both realized in the practice of this invention. Nakamura et al reports higher iodide concentrations within the corners of the tabular grains than elsewhere. Fenton et al reports a higher iodide concentration along the edges of the tabular grains with a lower iodide concentration within their corners than elsewhere along their edges.

The completed tabular grain emulsions preferably exhibit a mean ECD of less than 10 μm. For most applications the tabular grains have a mean ECD of less than 5.0 μm.

The host tabular grain emulsions as well as the tabular grain emulsions of the invention are contemplated to exhibit a COV of less than 30 percent and preferably less than 20 percent.

Apart from the features that have been specifically discussed, the high bromide tabular grain emulsions can contain conventional features of the type disclosed in the patents cited above to illustrate high bromide host tabular grain emulsions. These conventional features include conventional selections of dopants, vehicles and hardeners. Once prepared the emulsions can be chemically sensitized, spectrally sensitized, combined with antifoggants and stabilizers, image dye providing components, and other conventional photographic addenda. Such conventional features are illustrated by *Research Disclosure*, Vol. 389, September 1996, Item 38957.

EXAMPLES

The invention can be better appreciated by reference to the following specific examples. Except as otherwise indicated all weight percentages (wt %) are based on total weight.

Emulsions 1 through 17

These emulsions demonstrate the successful precipitation of tabular grain emulsions using a cationic starch derived from different plant sources, including a variety of potato and grain sources. The starches were selected to demonstrate a wide range of nitrogen and phosphorus contents.

Emulsion 1 AgIBr (3 mole % I) Tabular Grain Emulsion Made Using a Cationic Potato Starch A starch solution was prepared by boiling for 30 min a stirred mixture of 80 g cationic potato starch (STA-LOK ® 400, obtained from A. E. Staley Manufacturing Co., Decatur, Ill.), 27 moles of NaBr, and distilled water to 4 L. The cationic starch was a mixture of 21% amylose and 79% amylopectin and contained 0.33 wt % nitrogen in the form of a quaternary trimethyl ammonium alkyl starch ether and 0.13 wt % natural phosphorus. The cationic starch had an average molecular weight is 2.2 million. The resulting solution was cooled to 35° C., readjusted to 4 L with distilled water, and the pH was adjusted to 5.5. To a vigorously stirred reaction vessel of the starch solution at 35° C., a 2 M $AgNO_3$ solution was added at 100 mL per min for 0.2 min. Concurrently, a salt solution of 1.94M NaBr and 0.06M KI was added initially at 100 mL per min and then at a rate needed to maintain a pBr of 2.21. Then the addition of the solutions was stopped, 25 mL of 2M NaBr solution was added rapidly and the temperature of the contents of the reaction vessel was increased to 60° C. at a rate of 5° C. per 3 min. At 60° C., the $AgNO_3$ solution was added at 10 mL per min for 1 min then its addition rate was accelerated to 50 mL per min in 30 min until a total of 1.00 L had been added. The salt solution was concurrently added at a rate needed to maintain a constant pBr of 1.76. The resulting tabular grain emulsion was washed by diafiltration at 40° C. to a pBr of 3.38.

The tabular grain population of the resulting tabular grain emulsion was comprised of tabular grains with an average equivalent circular diameter of 1.2 μm, an average thickness of 0.06 μm, and an average aspect ratio of 20. The tabular grain population made up 92% of the total projected area of the emulsion grains. The emulsion grains had a coefficient of variation in diameter of 18%.

Emulsion 2 AgIBr (3 mole % I) Tabular Grain Emulsion Made Using a Cationic Corn Starch A starch solution was prepared by boiling for 30 min a stirred 400 g aqueous mixture containing 2.7 mmoles of NaBr and 8.0 g of a cationic hybrid corn starch (CATO ® 235, obtained from National Starch and Chemical Company, Bridgewater, N.J.) containing 0.31 wt % nitrogen and 0.00 wt % phosphorous.

The resulting solution was cooled to 35° C., readjusted to 400 g with distilled water. To a vigorously stirred reaction vessel of the starch solution at 35° C., pH 5.5 was added 2M $AgNO_3$ solution at a constant rate of 10 mL per min. Concurrently, a salt solution of 1.94M NaBr and 0.06M KI was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 60° C. at a rate of 5° C. per 3 min. At 60° C., the $AgNO_3$ solution was added at 1.0 mL per min for 1 min then its addition rate was accelerated to reach a flow rate of 5 mL per min in 30 min until a total of 100 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 1.6 μm, an average thickness of 0.06 μm, and an average aspect ratio of 27. The tabular grain population made up 85% of the total projected area of the emulsion grains.

Emulsion 3 AgIBr (3 mole % I) Tabular Grain Emulsion Made Using a Cationic Amphoteric Potato Starch This emulsion was prepared similarly to Emulsion 2, except that the starch used was a cationic amphoteric potato starch (Wespol A ®, obtained from Western Polymer Corporation, Moses Lake, Wash.) containing both a quaternary trimethyl ammonium alkyl starch ether, 0.36 wt % nitrogen, and orthophosphate (0.70 wt % phosphorous) substituents.

The tabular grain population of the resulting emulsion was comprised of tabular grains with an average equivalent circular diameter of 1.7 μm, an average thickness of 0.05 μm, and an average aspect ratio of 34. The tabular grain population made up 95% of the total projected area of the emulsion grains.

Emulsion 4 AgIBr (3 mole % I) Tabular Grain Emulsion Made Using a Cationic Amphoteric Potato Starch This emulsion was prepared similarly to Emulsion 3, except that the precipitation was stopped after 50 mL of the $AgNO_3$ solution was added.

The tabular grain population of the resulting emulsion was comprised of tabular grains with an average equivalent circular diameter of 1.0 μm, an average thickness of 0.045 μm, and an average aspect ratio of 25. The tabular grain population made up 95% of the total projected area of the emulsion grains.

Emulsion 5 AgIBr (3 mole % I) Tabular Grain Emulsion Made Using a Cationic Potato Starch and at pH 2.0.

This emulsion was prepared similarly to Emulsion 2, except that the emulsion was precipitated at pH 2.0 and the starch used was cationic potato starch (STA-LOK ® 400).

The tabular grain population of the resulting emulsion was comprised of tabular grains with an average equivalent circular diameter of 1.5 μm, an average thickness of 0.06 μm, and an average aspect ratio of 22. The tabular grain population made up 80% of the total projected area of the emulsion grains.

Emulsion 6 AgIBr (3 mole% I) Tabular Grain Emulsion Made Using a Cationic Corn Starch This emulsion was prepared similarly to Emulsion 2, except that the emulsion was precipitated at pH 6.0, and the starch used was a cationic waxy corn starch (STA-LOK ® 180, obtained from A. E. Staley Manufacturing Co.) made up of 100% amylopectin derivatized to contain 0.36 wt % nitrogen in the form of a quaternary trimethyl ammonium alkyl starch ether and 0.06 wt % phosphorous, average molecular weight 324,000.

The tabular grain population of the resulting emulsion was comprised of tabular grains with an average equivalent circular diameter of 1.6 μm, an average thickness of 0.06 μm, and an average aspect ratio of 27. The tabular grain population made up 91% of the total projected area of the emulsion grains.

Emulsion 7 AgBr Tabular Grain Emulsion Made by Adding 94% of a Cationic Potato Starch After Grain Nucleation A starch solution was prepared by boiling for 30 mina stirred 200 g aqueous mixture containing 3.75 moles of NaBr and 8.0 g of the cationic potato starch STA-LOK ® 400.

To a vigorously stirred reaction vessel of 12.5 g of the starch solution (0.5 g starch), 387.5 g distilled water, and 2.2 mole of NaBr at pH of 6.0 and 35° C. was added 2M $AgNO_3$ solution at a constant rate of 10 mL per min. Concurrently, a 2.5M NaBr solution was added initially at 10 mL per min and then at a rate needed to maintain a pBr of 2.21. After 0.2 min, the addition of the solutions was stopped, 2.5 mL of 2M NaBr was added rapidly, and the temperature of the contents of the reaction vessel was increased to 60° C. at a rate of 5° C. per 3 min. At 60° C., 187.5 g of the starch solution (7.5 g starch) was added, the pH was adjusted to 6.0 and maintained at this value throughout the remainder of the precipitation, and the $AgNO_3$ solution was added at 1.0 mL per min for 3 min and the NaBr solution was concurrently added at a rate needed to maintain a pBr of 1.76. Then the addition of the NaBr solution was stopped but the addition of the $AgNO_3$ solution was continued at 1.0 mL per min until a pBr of 2.00 was obtained. Then the addition of the $AgNO_3$ was accelerated at 0.05 mL per min squared and the NaBr solution was added as needed to maintain a pBr of 2.00 until a total of 0.20 mole of silver had been added.

The tabular grain population of the resulting emulsion was comprised of tabular grains with an average equivalent circular diameter of 1.0 μm, an average thickness of 0.055 μm, and an average aspect ratio of 18. The tabular grain population made up 90% of the total projected area of the emulsion grains.

Emulsion 8 AgIBr (3 mole % I) Tabular Grain Emulsion Made Using a Cationic Amphoteric Corn Starch This emulsion was prepared similarly to Emulsion 2, except that the starch used was a cationic amphoteric corn starch (STA-LOK ®356, obtained from A. E. Staley Manufacturing Co.) containing both a quaternary trimethyl ammonium alkyl starch ether (0.34 wt % nitrogen) and orthophosphate (1.15 wt % phosphorous) substituents. The cationic amphoteric starch was a mixture of 28% amylose and 72% amylopectin, with an average molecular weight of 486,000.

The tabular grain population of the resulting emulsion was comprised of tabular grains with an average equivalent circular diameter of 1.6 μm, an average thickness of 0.07 μm, and an average aspect ratio of 23. The tabular grain population made up 80% of the total projected area of the emulsion grains.

Emulsion 9 AGBr Tabular Grain Emulsion Made Using a Cationic Potato Starch

To a vigorously stirred reaction vessel containing 400 g of a solution at 35° C., pH 6.0 of 8.0 g cationic potato starch (STA-LOK ® 400) and 6.75 mmolar in NaBr was added a 2M $AgNO_3$ solution at a rate of 10 mL per min. Concurrently, a 2M NaBr solution was added initially at 10 mL per min and then at a rate needed to maintain a pBr of 2.21. After 0.2 min., the addition of the solutions was stopped, 2.5 mL of 2M NaBr was added rapidly and the temperature was increased to 60° C. at a rate of 5° C. per 3 min. At 60° C., the $AgNO_3$ solution was added at 1.0 mL per min for 1 min then its addition rate was accelerated to 5 mL per min in 30 min then held at this rate until a total of 200 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 2.2 μm, an average thickness of 0.08 μm, and an average aspect ratio of 28. The tabular grain population made up 85% of the total projected area of the emulsion grains.

Emulsion 10 AgIBr (3 mole % I) Tabular Grain Emulsion Made Using a Protonated Tertiary Aminoalkyl (Cationic) Corn Starch This emulsion was prepared similarly to Emulsion 2, except that the starch used was a corn starch (CATO-SIZE ® 69, obtained from National Starch and Chemical Co.) that, as obtained, was derivatized to contain tertiary aminoalkyl starch ethers, 0.25 wt % nitrogen, 0.06 wt % phosphorus. At a pH of 5.5, the tertiary amino groups were protonated to render the starch cationic.

The tabular grain population of the resulting emulsion was comprised of tabular grains with an average equivalent circular diameter of 1.2 μm, an average thickness of 0.08 μm, and an average aspect ratio of 15. The tabular grain population made up 55% of the total projected area of the emulsion grains.

Emulsion 11 AgIBr (3 mole % I) Tabular Grain Emulsion Made Using a Cationic Potato Starch and at pH 5.5 and 80° C.

This emulsion was prepared similarly to Emulsion 2, except that the starch used was cationic potato starch (STA-LOK ® 400) and the temperature was increased to 80° C. (instead of 60° C.).

The tabular grain population of the emulsion was comprised of tabular grains with an average equivalent circular diameter of 1.7 μm, an average thickness of 0.07 μm, and an average aspect ratio of 24. The tabular grain population made up 80% of the total projected area of the emulsion grains.

Emulsion 12 AgIBr (3 mole % I) Tabular Grain Emulsion Made Using a Cationic Corn Starch This emulsion was prepared similarly to Emulsion 2, except that the starch used was a cationic corn starch (CATO ® 25, obtained from National Starch and Chemical Company) containing 0.26 wt % nitrogen and 0.00 wt % phosphorous.

The tabular grain population of the resulting emulsion was comprised of tabular grains with an average equivalent circular diameter of 1.2 μm, an average thickness of 0.07 μm, and an average aspect ratio of 17. The tabular grain population made up 65% of the total projected area of the emulsion grains.

Emulsion 13 AgIBr (3 mole % I) Tabular Grain Emulsion Made Using a Cationic Corn Starch This emulsion was prepared similarly to Emulsion 2, except that the starch used was a cationic corn starch (Clinton 788 ®, obtained from ADM Corn Processing, Clinton, Iowa) containing 0.15 wt % nitrogen and 0.00 wt % phosphorous.

The tabular grain population of the resulting emulsion was comprised of tabular grains with an average equivalent circular diameter of 1.0 μm, an average thickness of 0.08 μm, and an average aspect ratio of 13. The tabular grain population made up 60% of the total projected area of the emulsion grains.

Emulsion 14 AgIBr (3 mole % I) Tabular Grain Emulsion Made Using a Cationic Wheat Starch This emulsion was prepared similarly to Emulsion 2, except that the starch used was a cationic wheat starch (K-MEGA® 53S, obtained from ADM/Ogilvie, Montreal, Quebec, Canada), which, as received was derivatized with a quaternary amine. The degree of substitution is 0.050 corresponding to 0.41 wt % nitrogen. The phosphorous was determined spectrophotometrically to be 0.07 wt %.

The tabular grain population of the resulting emulsion was comprised of tabular grains with an average equivalent circular diameter of 1.5 μm, an average thickness of 0.08 μm, and an average aspect ratio of 19. The tabular grain population made up 85% of the total projected area of the emulsion grains.

Emulsion 15 AgBr Tabular Grain Emulsion Made Using a Cationic Potato Starch

A starch solution was prepared by boiling for 30 min a stirred 400 g aqueous mixture containing 2.7 mmoles of NaBr and 8.0 g of the cationic potato starch STA-LOK ® 400.

The resulting solution was cooled to 35° C., readjusted to 400 g with distilled water. To a vigorously stirred reaction vessel of the starch solution at 35° C., pH 6.0 was added 2 M $AgNO_3$ solution at a constant rate of 10 mL per min. Concurrently, a 2M NaBr solution was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 50° C. at a rate of 5° C. per 3 min. At 50° C., the pH was adjusted to 6.0 and the $AgNO_3$ solution was added at 1.0 mL per min for 1 min, then its addition rate was accelerated to reach a flow rate of 5 mL per min in 30 min and held at this rate until a total of 200 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 1.2 μm, an average thickness of 0.10 μm, and an average aspect ratio of 12. The tabular grain population made up 70% of the total projected area of the emulsion grains.

Emulsion 16 AgIBr (3 mole % I) Tabular Grain Emulsion Made Using a Cationic Potato Starch of High Nitrogen Content A cationic potato starch solution containing a high nitrogen content was supplied by Western Polymer Corporation. The starch was 1.10 wt % in nitrogen and 0.25 wt % in natural phosphorous.

To 40 g of the starch solution, which contained 8 g of starch, was added 360 g distilled water and 2.7 mmoles of NaBr. This solution was placed in a reaction vessel and used to precipitate this emulsion using the procedure described in Emulsion 2.

The tabular grain population of the resulting emulsion was comprised of tabular grains with an average equivalent circular diameter of 1.2 μm, an average thickness of 0.09 μm, and an average aspect ratio of 13. The tabular grain population made up 80% of the total projected area of the emulsion grains.

Emulsion 17 AgBr Tabular Grain Emulsion Made Using a Cationic Potato Starch

A starch solution was prepared by boiling for 30 mina stirred 400 g aqueous mixture containing 2.7 mmoles of NaBr and 8.0 g of the cationic potato starch STA-LOK ® 400.

The resulting solution was cooled to 35° C., readjusted to 400 g with distilled water. To a vigorously stirred reaction vessel of the starch solution at 35° C., pH 6.0 was added 2M $AgNO_3$ solution at a constant rate of 10 mL per min. Concurrently, a salt solution of 2.5M NaBr was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 60° C. at a rate of 5° C. per 3 min. At 60° C., the pH was adjusted to 6.0 and the $AgNO_3$ solution was added at 1.0 mL per min for 1 min then its addition rate was accelerated to reach a flow rate of 5 mL per min in 30 min and held at this rate until a total of 200 mL of the $AgNO_3$ solution had been added. The salt solution was concurrently added at a rate needed to maintain a constant pBr of 1.76. Then the addition of the NaBr solution was stopped and the flow rate of the $AgNO_3$ solution was dropped to 1 mL per min. When the pBr reached 2.28, the NaBr solution flow was resumed to maintain this pBr. After 60 min of growth at this pBr, the pBr was adjusted to 3.04 and maintained at this value until a total of 0.53 moles of silver had been added.

The tabular grain population of the resulting emulsion was comprised of tabular grains with an average equivalent circular diameter of 2.0 μm, an average thickness of 0.14 μm, and an average aspect ratio of 14. The tabular grain population made up 85% of the total projected area of the emulsion grains.

Emulsions 18 through 22

These emulsions demonstrate tabular grain preparation failures resulting from choosing noncationic starches as peptizers.

Emulsion 18 AgIBr (3 mole % I) Nontabular Grain Emulsion Made Using a Water-Soluble Carboxylated (Noncationic) Corn Starch This emulsion was prepared similarly to Emulsion 2, except that the starch used was a corn starch (FILMKOTE ® 54, obtained from National Starch and Chemical Co.), which, as supplied, was derivatized to contain carboxylate groups. The nitrogen content was natural, 0.06 wt %.

A nontabular grain emulsion resulted.

Emulsion 19 AgIBr (3 mole % I) Nontabular Grain Emulsion Made Using a Water-Soluble Orthophosphate Derivatized (Noncationic) Potato Starch This emulsion was prepared similarly to Emulsion 2, except that the starch used was an orthophosphate derivatized potato starch 0.03 wt % nitrogen (natural), and orthophosphate substituents, 0.66 wt % phosphorous. The sample was obtained from Western Polymer Corporation.

A nontabular grain emulsion resulted.

Emulsion 20 AgIBr (3 mole % I) Nontabular Grain Emulsion Made Using a Water-Soluble Hydroxypropyl-substituted (Noncationic) Corn Starch.

This emulsion was prepared similarly to Emulsion 2, except that the starch (STARPOL ® 530, was obtained from A. E. Staley Manufacturing Co.) used was a hydroxypropyl-substituted corn starch, 0.06 wt % nitrogen (natural) and 0.12 wt % phosphorous.

A nontabular grain emulsion resulted.

Emulsion 21 AgIBr (3 mole % I) Nontabular Grain Emulsion Made Using a Water-Soluble (Noncationic) Potato Starch This emulsion was prepared similarly to Emulsion 2, except that the starch (Soluble Potato Starch obtained from Sigma Chemical Company, St. Louis, Mo.) used was a treated and purified water soluble potato starch, 0.04 wt % nitrogen and 0.06 wt % phosphorous.

A nontabular grain emulsion resulted.

Emulsion 22 AgIBr (3 mole % I) Nontabular Grain Emulsion Made Using a Water-Soluble (Noncationic) Wheat Starch This emulsion was prepared similarly to Emulsion 2, except that the starch (Supergel ® 1400, obtained from ADM/Ogilvie, Montreal, Quebec, Canada) used was a water soluble noncationic wheat starch.

A nontabular grain emulsion resulted.

Emulsion 23 AgIBr (3 mole % I) Nontabular Grain Emulsion Made Using the Grain Protein Zein This emulsion demonstrates to the failure of the grain protein zein to act as a peptizer.

In a stirred reaction vessel, 8.0 g of zein (obtained from Sigma Chemical Co.) in 400 g distilled water containing 2.7 mmole of NaBr was boiled for 60 min. Most of the zein did not appear to dissolve. The mixture was filtered and the filtrate was used as the starch solution to precipitate silver halide using conditions similar to those used in Emulsion 2.

The resulting precipitation resulted in large clumps of nontabular grains.

Emulsions 24 through 27

These emulsions demonstrate tabular grain preparation failures resulting from choosing noncationic starch-like substances as peptizers.

Emulsion 24 AgIBr (3 mole % I) Nontabular Grain Emulsion Made Using the Noncationic Polysaccharide Dextran This emulsion was prepared similarly to Emulsion 2, except that the polysaccharide dextran (obtained from Sigma Chemical Co., St. Louis, Mo.), having a molecular weight of approximately 500,000, was employed.

This emulsion was prepared similarly to Emulsion 2 except that the polysaccharide used was agar (purified, ash content <2%), obtained from Sigma Chemical Co.

The resulting precipitation resulted in large clumps and isolated nontabular grains. Agar was a poor peptizer for silver halide grains.

Emulsion 26 AgIBr (3 mole % I) Nontabular Grain Emulsion Made Using the Noncationic Polysaccharide Pectin This emulsion was prepared similarly to Emulsion 2, except that the polysaccharide used was pectin from citrus fruit (obtained from Sigma Chemical Co).

A nontabular grain emulsion resulted.

Emulsion 27 AgIBr (3 mole % I) Nontabular Grain Emulsion Made Using the Noncationic Polysaccharide, Gum Arabic This emulsion was prepared similarly to Emulsion 2, except that the polysaccharide used was gum arabic (obtained from Sigma Chemical Co.), having a molecular weight of about 250,000.

A nontabular grain emulsion resulted.

TABLE I

Emulsion Summary

| Emulsion (Control) | Peptizer | Cationic | Wt % Nitrogen | Wt % Phosphorus | Tabular Grains Present | Tabular Grains as % of Total Grain Projected Area |
|---|---|---|---|---|---|---|
| 1 | Potato Starch | Yes | 0.33 | 0.13[a] | Yes | 92 |
| 2 | Hybrid Corn S. | Yes | 0.31 | 0.00 | Yes | 85 |
| 3 | Potato Starch | Yes | 0.36 | 0.70 | Yes | 95 |
| 4 | Potato Starch | Yes | 0.36 | 0.70 | Yes | 95 |
| 5 | Potato Starch | Yes | 0.33 | 0.13[a] | Yes | 80 |
| 6 | Waxy Corn S | Yes | 0.36 | 0.06[a] | Yes | 91 |
| 7 | Potato Starch | Yes | 0.33 | 0.13[a] | Yes | 90 |
| 8 | Potato Starch | Yes | 0.34 | 1.15 | Yes | 80 |
| 9 | Potato Starch | Yes | 0.33 | 0.13[a] | Yes | 85 |
| 10 | Corn Starch | Yes | 0.25 | 0.03[a] | Yes | 55 |
| 11 | Potato Starch | Yes | 0.33 | 0.13[a] | Yes | 80 |
| 12 | Corn Starch | Yes | 0.26 | 0.00 | Yes | 65 |
| 13 | Corn Starch | Yes | 0.15 | 0.00 | Yes | 60 |
| 14 | Wheat Starch | Yes | 0.41[b] | 0.07[a] | Yes | 85 |
| 15 | Potato Starch | Yes | 0.33 | 0.13[a] | Yes | 70 |
| 16 | Potato Starch | Yes | 1.10 | 0.25[a] | Yes | 80 |
| 17 | Potato Starch | Yes | 0.33 | 0.13[a] | Yes | 85 |
| (18) | Corn Starch | No | 0.06[a] | 0.00 | No | 0 |
| (19) | Potato Starch | No | 0.03[a] | 0.66 | No | 0 |
| (20) | Corn Starch | No | 0.06[a] | 0.00 | No | 0 |
| (21) | Potato Starch | No | 0.04[a] | 0.06 | No | 0 |
| (22) | Wheat Starch | No | NM | NM | No | 0 |
| (23) | Zein | No | NM | NM | No | 0 |
| (24) | Dextran | No | NM | NM | No | 0 |
| (25) | Agar | No | NM | NM | No | 0 |
| (26) | Pectin | No | NM | NM | No | 0 |
| (27) | Gum Arabic | No | NM | NM | No | 0 |

[a]Natural content
[b]Calculated from the degree of substitution.
NM = Not Measured
NA = Not Applicable The resulting precipitation resulted in large clumps of nontabular grains. Dextran was unable to peptize the silver halide grains.

Emulsion 25 AgIBr (3 mole % I) Nontabular Grain Emulsion Made Using the Noncationic Polysaccharide, Agar Emulsion 28 AgIBr, 2.5 mole % Iodide, Tabular Grain Emulsion Having Higher Iodide at Corner Locations Than at Center, Made Using a Cationic Starch A polysaccharide solution was prepared by heating at 90° C. for 45 mina stirred 8,000 g aqueous mixture containing 54 mole NaBr and 160 g of an oxidized cationic waxy corn starch. (The polysaccharide, STA-LOK®140 is 100% amylopectin that had been oxidized with 2 wgt % chlorine bleach. It contains 0.31 wgt % nitrogen and 0.00 wgt % phosphorus. It was obtained from A. E. Staley Manufacturing Co., Decatur, Ill.)

The resulting solution was cooled to 40° C., readjusted to 8,000 g with distilled water, and then 0.294 mole of sodium acetate and 28 mg of Pluronic®-L43 were added. (Pluronic®-L43 was obtained from BASF Corp. and has the following formula; $HO(CH_2—CH_2O)_6(CH_2—CH(CH_3)O)_{22}—(CH_2—CH_2O)_6H$.) To a vigorously stirred reaction vessel of the starch solution at 40° C., pH 5.0, were added 4M $AgNO_3$ solution and 4M NaBr solution, each at a constant rate of 200 mL per min. After 0.2 min., the addition of the solutions was stopped, 100 mL of 2M NaBr was added rapidly, and the temperature of the contents of the reaction vessel was increased to 60° C. at a rate of 5° C. per 3 min; then 40 moles of ammonium sulfate solution were added and the pH of the contents was adjusted to 10.6 in 2 minutes using 2.5M NaOH solution. After 9 additional minutes at pH 10.6, the contents were adjusted to a pH of 5.0 using 4M $HNO_3$ and maintained at this value throughout the remainder of the precipitation. A 1M $AgNO_3$ solution was added at 10 mL per min and its addition rate was accelerated to reach a flow rate of 80 mL per min in 78 min. A 1.09 M NaBr solution was concurrently added at a rate needed to maintain a constant pBr of 1.44. After 3,000 mL of the 1M $AgNO_3$ solution had been added, its addition was stopped but the addition of the NaBr solution was continued at 80 mL per min until the pBr was 1.13. Then 760 mL of a 0.125M KI solution were added at 80 PaL per min. One minute after the addition of this KI solution, 560 mL of the 1M $AgNO_3$ solution was added at 80 mL per min. The emulsion was cooled to 40° C. and finally washed by diafiltration to a pBr of 3.34.

The resulting 2.5 mole % iodide AgIBr tabular grain emulsion consisted of tabular grains with an average equivalent circular diameter of 1.9 μm, an average thickness of 0.08 μm, and an average aspect ratio of 24. The tabular grain population made up 98% of the total projected area of the emulsion grains.

Analysis of the emulsion grains by transmission electron microscopy revealed that the tabular grains exhibited a distinct structural feature at some of the corners. Typically the feature contained many dislocation lines, with each feature containing at least 3 dislocation lines. A statistical analysis showed that 70% of the tabular grains had at least one corner with this distinct structural feature.

Composition analysis of selective regions of these tabular grains, using a focused beam of electron (diameter of about 800Å), showed that these corner regions (those containing dislocations) contained 6–8±2 mole % iodide, based on silver, while the adjoining edges of the tabular grain contained 0–1±2 mole % iodide, based on silver, and were free of detectable dislocations. The corner regions with dislocations, as described above, contained more iodide than the edge region. The central region of these grains had no observed dislocations and contained 0–1±2 mole % iodide.

EVALUATION OF PHOTOGRAPHIC PERFORMANCE

Coated Sample 28-Blue-S+Au

A sample of Emulsion 28 was chemically sulfur and gold sensitized and spectrally sensitized to the blue region of the spectrum as follows:

At 40° C., with stirring, sodium acetate solution was added (31 mmole per Ag mole) and the pH of the emulsion was adjusted to 5.6. Then sequentially the following solutions of these salts were added so that the emulsion contained (mmole/Ag mole); 2.5 of NaSCN, 0.22 of a benzothiazolium salt, 1.2 of anhydro-5,5'-dichloro-3,3'-bis(3-sulfopropyl)thiacyanine hydroxide triethylammonium salt, and 0.08 of 1-(3-acetamidophenyl)-5-mercaptotetrazole sodium salt, 0.021 of 1,3-dicarboxymethyl-1,3-dimethyl-2-thiourea and 0.0084 of bis(1,3,5-trimethyl-1,2,4-triazolium-3-thiolate) gold (I) tetrafluoroborate. The mixture was heated to 55° C. at a rate of 1.67 ° C./min, and held at 55° C. for 15 min. Upon cooling to 40° C., a solution of 1.68 mmole per Ag mole of 5-bromo-4-hydroxy-6-methyl-1,3,3a,7-tetraazaindene was added.

The resulting sensitized emulsion was mixed with gelatin, a yellow dye-forming coupler dispersion, surfactants, and hardener and coated onto a clear photogrpahic film support at 0.80 g/m$^2$ silver, 1.7 g/m$^2$ of yellow dye-forming coupler, and 3.5 g/m$^2$ of gelatin to complete the coated sample.

Coated Sample 28-Blue

Another sample of Emulsion 28 was spectrally sensitized to the blue portion of the spectrum, but not treated with sulfur and gold chemical sensitizing reagents. At 40° C., with stirring, sodium acetate solution was added (31 mmole per Ag mole) and the pH of the emulsion was adjusted to 5.6. Then a methanol solution of 1.2 mmole per Ag mole of anhydro-5,5'-dichloro-3,3'-bis(3-sulfopropyl)thiacyanine hydroxide triethylammonium salt was added. The mixture was stirred for 30 min at 40° C.; then a solution of 1.68 mmole per Ag mole of 5-bromo-4-hydroxy-6-methyl-1,3,3a,7-tetraazaindene was added.

The resulting sample, 28-Blue, was coated similarly as Sample 28-Blue-S+Au.

Evaluation

The coatings of Samples 28-Blue and 28-Blue-S+Au were exposed to blue light for 0.02 sec through a 0 to 4.0 log density graduated step-tablet and processed in a Kodak Flexicolor™ C-41 color negative process using a development time of 3 min 15 sec. The results are summarized in Table I.

TABLE II

| Coating | $D_{max}$ | $D_{min}$ | Mid-Scale Contrast | Speed |
|---|---|---|---|---|
| 28-Blue | 1.55 | 0.07 | 2.27 | 1.00 |
| 28-Blue-S + Au | 3.18 | 0.13 | 2.13 | 2.60 |

Speed was measured at a density of 0.2 above minimum density and is reported in relative log speed units, where 1 relative log speed unit equals 0.01 log E, where E is exposure in lux-seconds.

Tablue II demonstrates both coatings 28-Blue and 28-Blue-S+Au to be photographically useful emulsions. A 1.6 log E increase in photographic speed was achieved by the chemical sensitization of 28-Blue-S+Au.

Coated Sample 28-Green

A sample of Emulsion 28 was spectrally sensitized to green light as follows: To the sample were added 1.12 mole per Ag mole of a solution of anhydro-5-chloro-9-ethyl-5'-phenyl-3'-(3-sulfobutyl)3-(3-sulfopropyl)oxacarbocyanine hydroxide triethylammonium salt and 0.25 mmole per Ag mole of a solution of anhydro-3,9-diethyl-5-phenyl-3'-methylsulfonylcarbamoylmethyloxathiacarbocyanine hydroxide.

Evaluation

The green sensitized emulsion was mixed with dye-forming coupler, gelatin, surfactant and hardener and coated on clear cellulose acetate photographic film support, resulting in a coating with 0.81 $g/m^2$ of silver, 1.0 $g/m^2$ of dye-forming coupler and 3.2 $g/m^2$ of gelatin.

The coating was exposed to green light for 0.5 sec through a 0 to 4.0 log density graduated step-tablet and processed in a Kodak Flexicolor™ C-41 color negative process using a development time of 4 min. The resulting color photographic image of the graduated step-tablet had a maximum density of 2.37, a minimum density of 0.05, and a mid-scale contrast of 1.51.

The invention has been described in detail with particular reference to preferred embodiments thereof, but it will be understood that variations and modifications can be effected within the spirit and scope of the invention.

What is claimed is:

1. A photographic emulsion comprised of radiation-sensitive silver halide grains and a hydrophilic colloid peptizer, wherein (1) at least 50 percent of total grain projected area is accounted for by tabular grains each comprised of (a) less than 12 mole percent iodide and greater than 50 mole percent bromide, based on silver, (b) a central region accounting for at least 50 percent of grain projected area, and (c) a peripheral region containing crystal lattice dislocations and a higher iodide concentration than the overall average iodide concentration of the tabular grains, and (2) the hydrophilic colloid peptizer is derived from a water dispersible cationic starch.

2. A photographic emulsion according to claim 1 wherein the cationic starch is comprised of α-amylose.

3. A photographic emulsion according to claim 1 wherein the cationic starch is comprised of amylopectin.

4. A photographic emulsion according to claim 1 wherein the starch contains cationic moieties selected from among protonated amine moieties and quaternary ammonium, sulfonium and phosphonium moieties.

5. A photographic emulsion according to claim 1 wherein the cationic starch contains α-D-glucopyranose repeating units having 1 and 4 position linkages.

6. A photographic emulsion according to claim 5 wherein the cationic starch additionally contains 6 position linkages in a portion of the α-D-glucopyranose repeating units to form a branched chain polymeric structure.

7. A photographic emulsion according to claim 1 wherein the cationic starch is oxidized.

8. A photographic emulsion according to claim 7 wherein the oxidized cationic starch contains α-D-glucopyranose repeating units and, on average, at least one oxidized α-D-glucopyranose unit per starch molecule.

9. A photographic emulsion according to claim 8 wherein at least 1 percent of the α-D-glycopyranose units are ring opened by oxidation.

10. A photographic emulsion according to claim 9 wherein from 3 to 50 percent of the α-D-glycopyranose units are ring opened by oxidation.

11. A photographic emulsion according to claim 9 wherein the oxidized α-D-glucopyranose units contain two —C(O)R groups, where R completes an aldehyde or carboxyl group.

12. A photographic emulsion according to claim 8 wherein the oxidized α-D-glucopyranose units are dialdehydes.

13. A photographic emulsion according to claim 1 wherein the peripheral region contains at least 1 mole percent iodide, based on total silver.

14. A photographic emulsion according to claim 1 wherein the iodide concentration in the central region is less than half the iodide concentration in the peripheral region.

15. A photographic emulsion according to claim 1 wherein the silver halide grains exhibit a coefficient of variation of less than 30 percent.

* * * * *